US005454221A

United States Patent [19]

Loprinzo

[11] Patent Number: 5,454,221

[45] Date of Patent: Oct. 3, 1995

[54] DILUTION FLOW SLEEVE FOR REDUCING EMISSIONS IN A GAS TURBINE COMBUSTOR

[75] Inventor: Anthony J. Loprinzo, Clifton Park, N.Y.

[73] Assignee: General Electric Company, Schenectady, N.Y.

[21] Appl. No.: 212,407

[22] Filed: Mar. 14, 1994

[51] Int. Cl.[6] ..... F23R 3/06; F02C 3/14

[52] U.S. Cl. ..... 60/39.06; 60/757; 60/759

[58] Field of Search ..... 60/755, 757, 759, 60/748, 760, 39.02, 39.06

[56] References Cited

U.S. PATENT DOCUMENTS

| | | | |
|---|---|---|---|
| Re. 23,149 | 9/1949 | Lubbock et al. | 60/748 |
| 4,475,344 | 10/1984 | Mumford et al. | 60/757 |
| 4,984,429 | 1/1991 | Waslo et al. | 60/757 |
| 5,117,636 | 6/1992 | Bechtel et al. | 60/757 |
| 5,277,021 | 1/1994 | Shekleton | 60/755 |

FOREIGN PATENT DOCUMENTS

| | | | |
|---|---|---|---|
| 2020371 | 11/1979 | United Kingdom | 60/759 |

*Primary Examiner*—Timothy S. Thorpe
*Attorney, Agent, or Firm*—Nixon & Vanderhye

[57] ABSTRACT

Sleeves (28) are circumferentially spaced from one another about the liner of a combustor body (12) of a dry low $NO_x$ combustor. The sleeves carry dilution air into the dilution zone. Cooling air is supplied a venturi (20) to cool the venturi and the cooling air flows into the reaction volume. The dilution air sleeves penetrate sufficiently to thoroughly mix the dilution air with the core of hot gases of combustion and, by vorticity effects caused by the flow past the sleeves, thoroughly mix the generally annular flow of cooling air from the venturi with the hot gases of combustion. The thorough mixing of both the cooling air and dilution air inhibits or minimizes the formation of cold areas or streaks within the reaction volume such that CO to $CO_2$ reactions are not quenched, affording reduced CO emissions.

3 Claims, 2 Drawing Sheets

DILUTION FLOW SLEEVE FOR REDUCING EMISSIONS IN A GAS TURBINE COMBUSTOR

TECHNICAL FIELD

The invention relates to combustors for turbines and particularly to apparatus and methods for reducing air pollutants such as $NO_x$, CO and unburned hydrocarbons from the combustion process by improved mixing of cooling and dilution air with the hot gases of combustion. More particularly, the invention relates to apparatus and methods for enhancing aerodynamic mixing in a gas turbine combustor by increasing dilution air penetration into the core flow of hot gases of combustion and introducing streamwise vorticity downstream of the dilution air inlet,

BACKGROUND

In one type of dry low $NO_x$ combustor for a gas turbine, there is provided a combustor body including a plurality of primary fuel nozzles arranged about a central secondary fuel nozzle at one end of the combustor body, a venturi downstream from the nozzles, a combustion liner defining a reaction volume, a dilution plane for admitting dilution air, and a cooling air flow arranged about the venturi walls to cool the venturi, the cooling air flowing into the reaction volume of the combustor downstream of the venturi. Also, dilution holes are often formed in the liner of the combustor in a dilution zone for purposes of shaping the gas temperature profile exiting the combustion system and providing a region for CO burnout. In the reaction volume of the combustor, carbon monoxide (CO), an undesirable pollutant and emission from a gas turbine combustion system, reacts at high temperature with air in the system to form carbon dioxide ($CO_2$). For example, CO will react to $CO_2$ at a temperature above approximately 1800° F. but generally not below that temperature. Typically, the hot gases of combustion flow axially in the combustor in a core flow which obtains a temperature of about 2400° F. Thus, the reaction of CO to $CO_2$ occurs in the core flow as a natural result of its elevated temperature.

Compressor discharge air is typically used as a source of cooling air for the combustor, as well as for the dilution air flow, and has a combustor inlet temperature of approximately 600°–700° F. The cooling air for cooling the walls of the venturi about the flame holder conventionally flows into the combustion liner in the form of an annular flow. Consequently, there is an annular region of relatively cooler air flow about the centrally located core flow of the hot gases of combustion as the gases flow toward the first-stage nozzle. Moreover, while cooling air inlet admitted through dilution holes or openings in the combustor liner beneficially reduces the exit temperature of the combustor, it typically remains in cooler regions of the flow without completely mixing with the higher temperature gases of the flow. As a consequence, there are regions or streaks in the reaction volume where the cooling and/or dilution air forms a flow region having insufficient temperature to enable the carbon monoxide to react with the oxygen in the gas flow to form the more desirable carbon dioxide emissions. In short, there is a quenching of the CO to $CO_2$ reactions in the cooler flow because the CO in that cooler gas flow region or streak does not reach the elevated temperature necessary for the reaction to occur.

DISCLOSURE OF THE INVENTION

In accordance with the present invention, there is provided a dilution flow bluff body sleeve which penetrates inwardly of the liner for delivering dilution air flow into the hot core gases of combustion and which also introduces streamwise vorticity in the downstream wake of the bluff body sleeve whereby the dilution air and cooling air are well mixed with the hot gases of combustion to avoid quenching the CO to $CO_2$ reactions. To accomplish the foregoing, there is provided a combustor having a combustor body with fuel nozzles at one end of the body, a venturi for establishing a flame and a liner defining a reaction volume and a dilution plane downstream of the venturi for admitting dilution air into the hot gases of combustion. The dilution air is admitted through sleeves which project inwardly from the liner such that the dilution air exiting the sleeves penetrates the core region of the hot gases of combustion. In this manner, dilution air is thoroughly mixed with the hot core combustion gases. The mixture thus obtains a temperature sufficiently high to enable the CO to $CO_2$ reactions to occur. That is, the cooling dilution air is inlet to the reaction volume such that its temperature is elevated sufficiently by the mixing process to preclude quenching of the CO to $CO_2$ reactions. Additionally, the cooling air from the venturi flows about the dilution air inlet sleeves and forms vortices downstream of the sleeves. These vortices enhance the mixing of the cooling air with the hot gases of combustion. In this manner, temperature gradations across and throughout the reaction volume are minimized and the temperature of the mixed hot gases of combustion and cooling air is sufficiently high to permit the CO to $CO_2$ reactions to proceed.

More particularly, the reaction volume within the combustor body may be characterized as including first and second reaction zones separated by the dilution zone. In the first reaction zone upstream of the dilution zone, a core of hot gases of combustion flow downstream, essentially surrounded by a cooler annular layer of cooling air, the core of hot gases and cooling air being relatively unmixed. In the second reaction zone downstream of the dilution zone, the mixing is substantially thorough and complete as a result of dilution air flowing through the penetrating sleeves directly into the hot core combustion gases and the bluff body effects of the sleeves themselves, producing downstream vortices. Thus, primary mixing of the cooling air annular flow and the dilution air is performed by the vortices and the penetration of the dilution air into the core flow of the gases of combustion, respectively. In both cases, this thorough mixing action inhibits and minimizes the formation of cooler zones within the flow which might otherwise have temperatures lower than the temperature necessary to permit the CO to $CO_2$ reactions to occur.

In a preferred embodiment according to the present invention, there is provided a combustor for a turbine comprising a combustor body, a nozzle for supplying fuel into the combustor body, the combustor body including a combustion liner downstream of the fuel nozzle defining a reaction volume for containing a generally axially extending core flow of hot gases of combustion, and at least one flow sleeve extending inwardly of the liner into the reaction volume for supplying dilution air into the core flow to facilitate CO to $CO_2$ reactions and thereby minimize CO emissions.

In a further preferred embodiment according to the present invention, there is provided in a combustor for a turbine having a combustor body including a combustor liner defining a reaction volume, and a nozzle for supplying fuel to the combustor body, a method for reducing CO emissions from combustion within the combustor, comprising the steps of supplying dilution air into the reaction volume and mixing the dilution air with a core flow of hot gases of combustion in the reaction volume sufficiently to elevate the temperature of the dilution air to substantially preclude quenching CO to $CO_2$ reactions in the flow of hot gases.

Accordingly, it is a primary object of the present invention to provide in a gas turbine apparatus and methods for enhancing the mixing of cooling air, dilution air and hot gases of combustion to prevent quenching CO to $CO_2$ reactions and hence afford improved emission levels for the turbine.

BEST MODE FOR CARRYING OUT THE INVENTION

Figure 1:
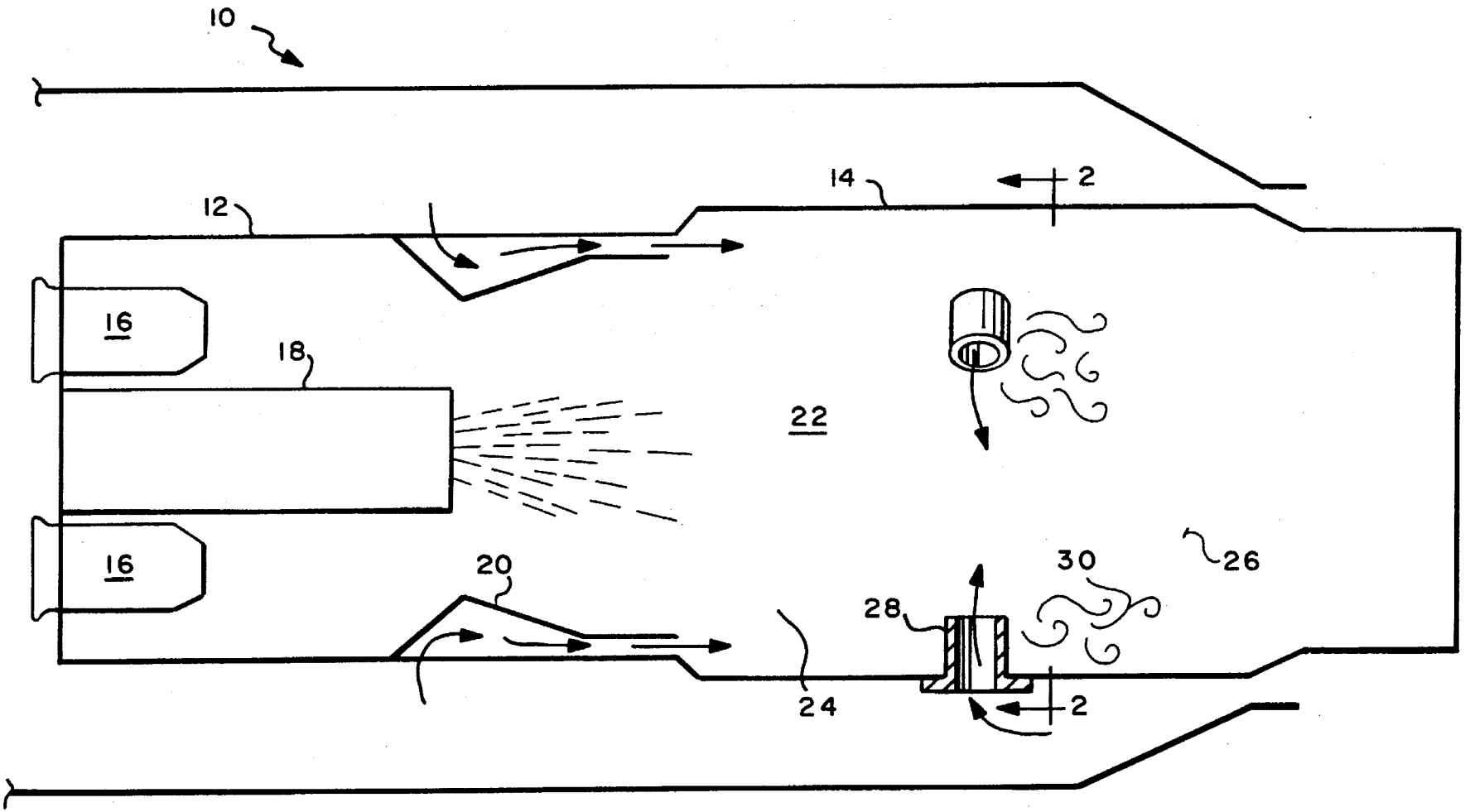
FIG. 1 is a schematic illustration of a combustor constructed in accordance with the present invention.
Figure 2:
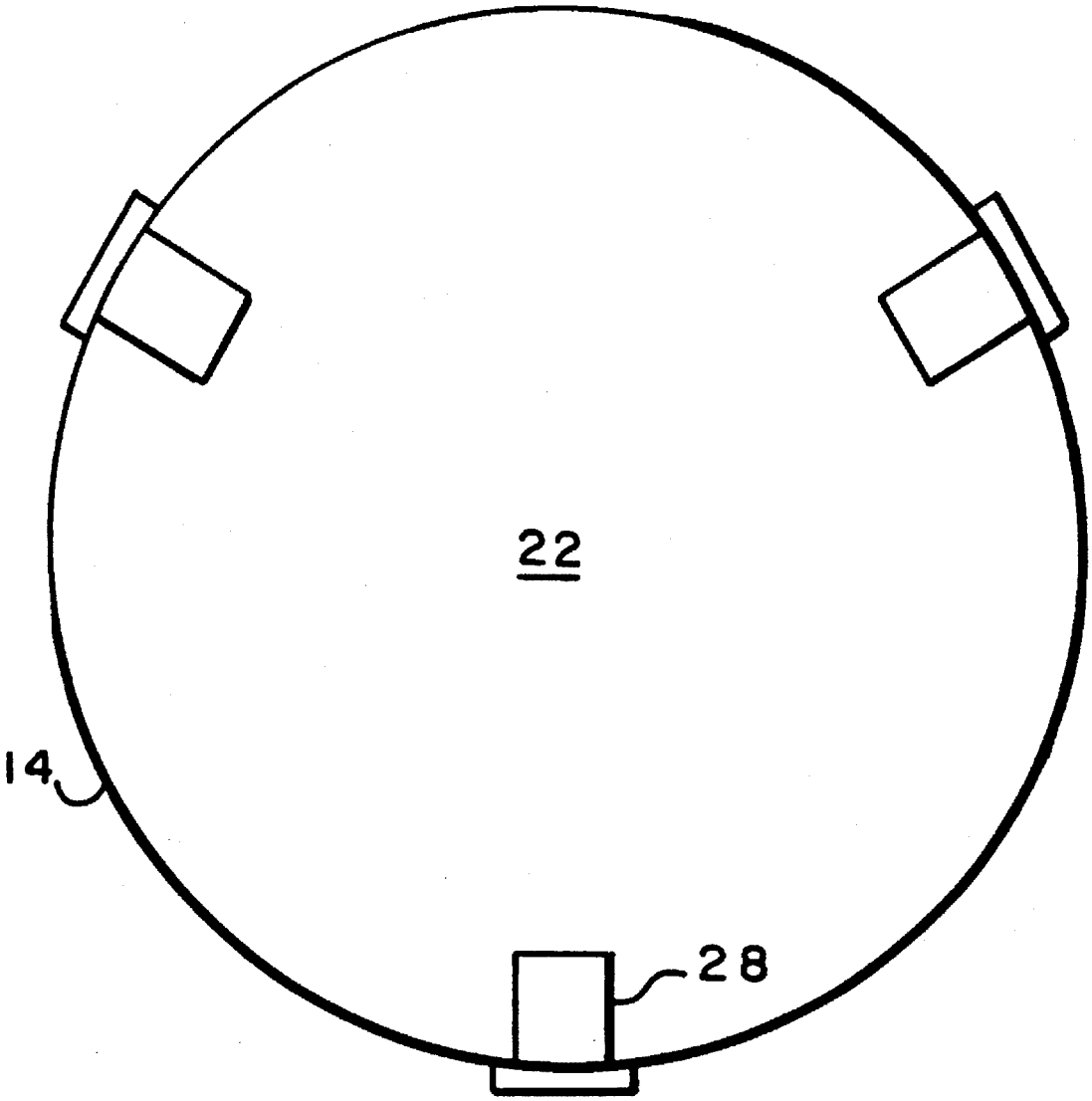
FIG. 2 is a cross-sectional view thereof generally taken along line 2—2 in FIG. 1.

Referring now to FIG. 1, there is illustrated a dry low $NO_x$ combustor, generally designated 10, constructed in accordance with the present invention. Combustor 10 comprises a combustor body 12 having a liner 14, primary and second fuel nozzles 16 and 18, respectively, a venturi 20 and a reaction volume 22 within the venturi 20 and liner 14. It will be appreciated that fuel is supplied to the nozzles and that hot gases of combustion are generated within the reaction volume for flow generally axially downstream and into the first stage of a turbine, not shown.

Cooling air is provided along the outside wall of the venturi 20. The cooling air is supplied from the discharge of a compressor, not shown, and flows into an annulus about the venturi 20 for flow into the reaction volume in a generally annular configuration adjacent the walls of the combustor body 12 and liner 14. A proportion of the compressor discharge air is used for supplying dilution air in a dilution plane or zone in the reaction volume. The dilution plane is defined by dilution air inlets, i.e., sleeves, on opposite sides of which is a first reaction zone 24 upstream of the dilution plane and a second reaction zone 26 downstream of the dilution plane. Generally, the first reaction zone in reaction volume 22 upstream of the dilution plane comprises a high temperature core of hot gases of combustion and a relatively cooler surrounding annular flow of cooling air from venturi 20. These two flows, while mixed to some extent, are not mixed sufficiently to avoid temperature gradients and cold streaks in this first reaction zone which inhibit CO to $CO_2$ reactions.

In accordance with the present invention, the second reaction zone 26 downstream of the dilution plane comprises generally very thoroughly mixed hot gases of combustion and the cooling air flows from the venturi and the dilution air inlet to the reaction volume. Because the flows are thoroughly mixed in the second reaction zone downstream of the dilution zone, temperature gradients in the flow in that zone are minimized. Hence, any relatively cooler regions or streaks that may occur in the mixed gases in the second reaction zone have temperatures generally sufficient to preclude quenching CO to $CO_2$ reactions.

To thoroughly mix the cooling air flow from venturi 20 and the dilution air flow with the hot gases of combustion in the reaction volume 22, and in accordance with the present invention, there are provided dilution air flow inlet sleeves 28. Sleeves 28 enable penetration of the dilution air inwardly toward the central axis of the combustor a substantial distance sufficient to permit direct mixing of the dilution air and the hot core gases at a mix temperature elevated sufficiently to prevent quenching CO to $CO_2$ reactions. To accomplish this, the sleeves 28 preferably project radially inwardly a distance 5 such that the outlets of the sleeves 28 lie adjacent margins of the hot core gas flow, thus enabling the dilution air to mix thoroughly with the hot axially flow core gases of combustion of the combustor. That is, the dilution air is prevented from flowing downstream directly adjacent the walls of the liner in a relatively cooler zone. It will be appreciated that while three generally radially inwardly directed cylindrical sleeves 28 located at circumferentially spaced positions about the circumference of the combustor body are illustrated, a greater or lesser number of sleeves 28 may be provided, preferably at equally circumferentially spaced positions about the combustor body to provide air into the dilution plane. Sleeves 28 are preferably cylindrical in cross-section but may be formed of other cross-sectional configurations. They may also be directed such that the incoming dilution air flow through the sleeves may have circumferential and/or axial components. Further, the sleeves may be located at axially spaced positions to define a broader dilution plane.

It will also be appreciated that sleeves 28 form a bluff body in an aerodynamic stream. As well known, cylindrical bluff bodies in crossflow form Vorrkarman vortex sheets in the downstream wake of the body. These vortices are illustrated at 30. As a consequence, the generally annular-shaped cooling flow passing the sleeves 28 along the wall of the combustor body is thoroughly mixed with the hot gases of combustion downstream of the sleeves by the interaction of the vortices and the hot flow of combustion gases.

It will therefore be appreciated that the radially penetrating sleeves hereof for supplying dilution air into the dilution plane, provide for thorough mixing of both the cooling and dilution air flows with the hot gases of combustion, affording a greater uniformity of temperature in the mixed hot gases in the second reaction zone downstream of the dilution plane flowing toward to the first-stage nozzle of the turbine. By thoroughly mixing the cooling air flow and the dilution air flow with the hot gases of combustion, cold streaks in the flow are minimized and the temperature of the thoroughly mixed gases is sufficiently and uniformly high to substantially preclude quenching CO to $CO_2$ reactions whereby CO emissions are minimized or eliminated.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims.

What is claimed is:

1. In a combustor for a turbine having a combustor body including a combustor liner defining a reaction volume including first and second reaction zones and a dilution zone therebetween, and a nozzle for supplying fuel to the combustor body, a method for reducing CO emissions from the combustor, comprising the steps of:

supplying in said first reaction zone upstream of said dilution zone a generally annular flow of cooling air surrounding a core flow of hot gases of combustion, the annular cooling air flow and the core flow of hot gases being relatively unmixed;

supplying dilution air into the reaction volume and directly into the core flow of hot gases; and mixing the cooling air and the dilution air with the core flow of hot gases of combustion in the second reaction zone downstream of said dilution zone and elevating the temperature of the mixed cooling air, dilution air and core flow of hot gases of combustion by said mixing to substantially preclude quenching CO to $CO_2$ reactions in the flow of hot gases.

2. A method according to claim 1 wherein the step of supplying dilution air includes penetrating the flow of hot gases of combustion with sleeves for flowing dilution air directly into the core flow of hot gases of combustion.

3. A method according to claim 2 including cooling, and flowing the cooling air past the sleeves to generate vorticity to facilitate mixing the cooling air and the hot gases of combustion.

* * * * *